United States Patent [19]

Galbraith

[11] Patent Number: 4,915,279

[45] Date of Patent: Apr. 10, 1990

[54] POCKET CADDY

[76] Inventor: Terry L. Galbraith, 8392 Holly Rd., Avoca, Mich. 48006

[21] Appl. No.: 180,763

[22] Filed: Apr. 12, 1988

[51] Int. Cl.[4] ..... A45F 5/02

[52] U.S. Cl. ..... 224/230; 224/249; 224/252; 224/253; 224/269; 24/3 H; 24/563

[58] Field of Search ..... 224/182, 226, 230, 232, 224/234, 249, 252, 253, 255, 256, 268, 269, 904, 914–916, 918, 922; 248/113; 211/66; 24/3 A, 3 F, 3 H, 3 L, 3 R, 531, 532, 546, 563; D21/234

[56] References Cited

U.S. PATENT DOCUMENTS

| | | | |
|---|---|---|---|
| 1,022,791 | 4/1912 | Laird, Jr. | 224/249 |
| 1,123,231 | 1/1915 | Bradley | 24/563 |
| 2,589,126 | 3/1952 | Payne | 224/253 |
| 2,881,492 | 4/1959 | Aspes | 224/252 |
| 2,894,119 | 7/1959 | Stenger | 224/249 |
| 2,938,252 | 5/1960 | Scheemaeker | 24/563 |
| 3,830,415 | 8/1974 | Jacobsen et al. | 224/249 |
| 4,056,218 | 11/1977 | Barna | 224/255 |
| 4,100,652 | 7/1978 | Carlson | 24/3 |
| 4,414,716 | 11/1983 | Stastney | 24/563 |
| 4,475,676 | 10/1984 | Smith | 224/252 |
| 4,587,818 | 5/1986 | Griffin | 224/252 |

*Primary Examiner*—Henry J. Recla
*Assistant Examiner*—J. Casimer Jacyna
*Attorney, Agent, or Firm*—Irving M. Weiner; Pamela S. Burt; Joseph P. Carrier

[57] ABSTRACT

A single golf club carrying device for attachment to the golfer's belt-line or pocket. The device is preferably a single piece of flat, resilient material having a U-shaped slit defining a flap. Communicating with the slit are orifice and club-receiving hole cut-outs. When the background material is put into the golfer's pocket or belt-line, the resultant flap will hang outside the golfer's clothing, in order to removably receive and carry a golf club.

9 Claims, 4 Drawing Sheets

POCKET CADDY

BACKGROUND OF THE INVENTION

The present invention relates generally to a golf club carrying device. More particularly, the present invention relates to a single golf club carrying device which may be inserted into a golfer's pocket or belt or waistband in order to removably hold a single golf club, allowing the golfer the use of her/his hands for swinging another club, or other such purpose.

Golfer's from time to time will find themselves on or near the green with two clubs in their hands, having left their golf bag by the next tee area or at their riding cart which may be a considerable distance away. Thus in order to use both hands to play the game the golfer must lay down that one club which she/he is not using. This may expose the golf club grips to moisture or other environmental contaminants and may lead to the possibility of golf club loss or a safety hazard should the player forget the club and leave it on the ground for others to improperly dispose of or trip over. The present invention provides a comfortable and economic single club carrier which may be worn on the person of the golfer, convenient and available to hold a club above the ground. Because the device is basically flat it may be attached inside a pocket, inside a waistband, or worn over a belt, and should therefore always be available for use by the golfer no matter what her/his clothing choice.

The envisioned device is further simple and economical to manufacture.

SUMMARY OF THE INVENTION

According to the present invention there is provided an attachment means with an extending flap having means for carrying a single golf club. Preferably, but not necessarily, the invention should be manufactured from a single piece of rectangular material by stamping, or molding as a single unit, a slot within the interior of said material to form a flap; the flap having formed therein a second slot and hole for securely and detachably receiving a golf club shaft.

Accordingly it is an object of the present invention to provide a single golf club holder, attachable to the clothing of the golfer, so that should a golfer find herself/himself holding an extra club she/he may attach it to her/his person thereby eliminating the need to place the club on the ground with all the attendant problems that such placement could entail.

DETAILED DESCRIPTION OF THE PREFERRED EMBODIMENT

Figure 1:
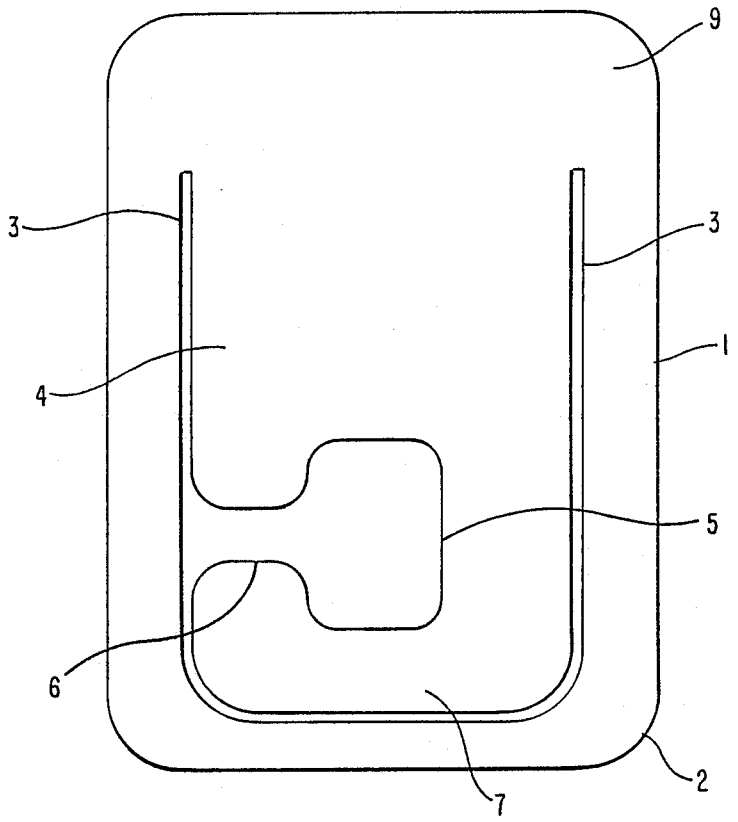
FIG. 1 is a front view of the golf club carrier of the present invention according to the preferred embodiment.
Figure 2:
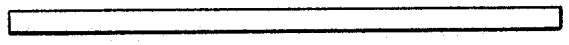
FIG. 2 is a top plan of the present invention according to the preferred embodiment.
Figure 3:
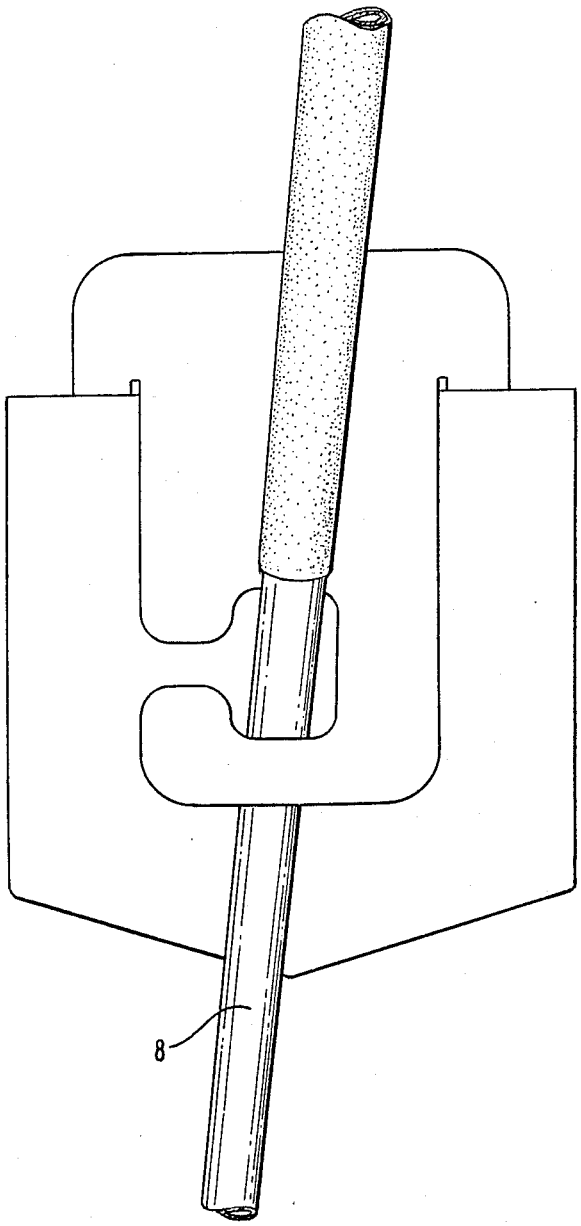
FIG. 3 illustrates the preferred embodiment of the present invention as utilized in holding a golf club in conjunction with a pants pocket of the wearer.
Figure 4:
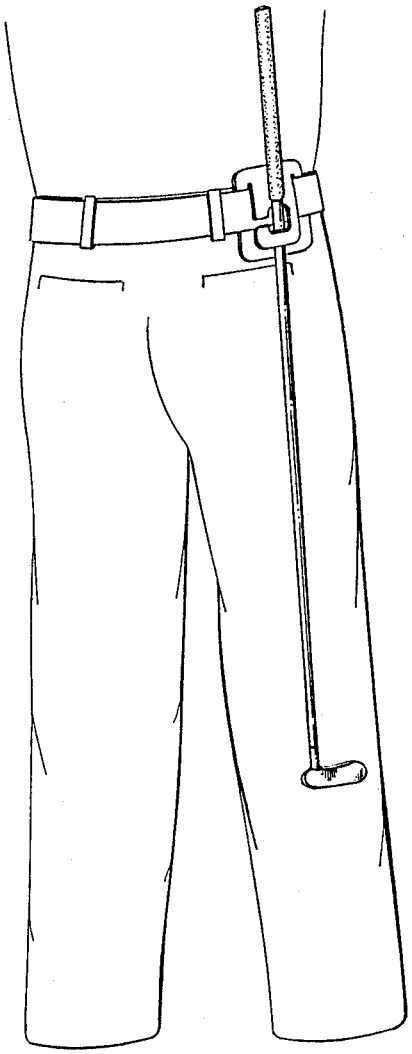
FIG. 4 illustrates the utilization of the present invention as installed over the belt of the wearer.
Figure 5:
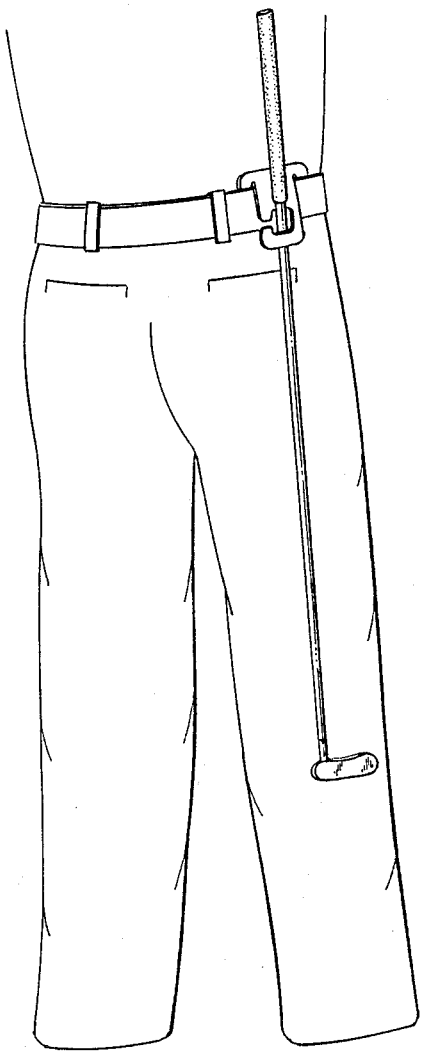
FIG. 5 illustrates the present invention as utilized in conjunction with the waistband of the wearer.
Figure 6:
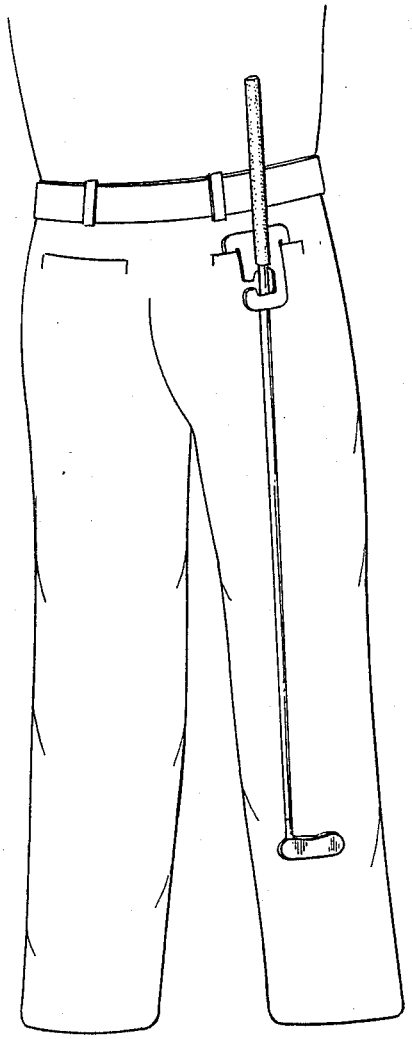
FIG. 6 illustrates the present invention as utilized with the back trouser pocket of the wearer.

Referring to FIG. 1, there is shown a golf club carrying device according to the preferred embodiment of the present invention. The main body of the device is formed of a single sheet 1 of suitably resilient material for example, plastics. The outside dimensions are preferably, but not necessarily, three and one half by five inches, thereby making the overall shape rectangular and suitable for insertion into a wearer's pants pocket. Further, to aid in ease of insertion and removal of the device from the clothing of the wearer, the corners 2 are rounded.

The single piece of material 1 will have cut or molded therein a slot 3 which according to the preferred embodiment is U-shaped, the upright legs of the U being approximately four inches long. The horizontal portion of the U-shaped slit according to the preferred embodiment is approximately 2.5 inches long. This slot 3 extends through the entire thickness of the single piece 1 and defines interiorly a flap 4, and peripheral support 9 exteriorly.

Communicating with the slot 3 is a second slot 6 leading to a golf club receiving hole 5. The hole in the preferred embodiment is a basically rectangular shape with rounded corners having a long vertical dimension of 1.2 inches and a shorter horizontal dimension of 0.8 inches. According to the preferred embodiment, the orifice has a horizontal dimension of 0.7 inches and a vertical dimension of 0.4 inches.

In use, the golfer would place the peripheral support 9 on the inside of a pocket, belt, or waistband and leave the flap 4 containing the hole 5 and slot 6 on the outside of her/his clothing.

When a golf club is needed to be stored the golfer merely places the shaft of the golf club 8 through the slot 6 and rests it in the hole 5. The resilient material of the flap 4 and lower hooked portion 7 will thereby frictionally engage the golf club shaft and hold it in place.

It will be understood that when the apparatus is not in use, the flap 4 and peripheral support 9 including the upper main body portion are adapted to be substantially coplanar, whereas the flap 4 is angled outwardly when the golf club is depending from the flap.

In the preferred embodiment the single piece of material is 0.15 inches thick, thereby being substantially flat for comfort and ease of wear and yet thick enough to serve its intended purpose of frictionally engaging the golf club shaft 8.

While the present invention has been illustrated and described in connection with a preferred embodiment, it is not to be limited to the particular structure or function shown. For instance the invention could be readily adapted as a carrier for hand tools such as hammers, wrenches, and the like or other devices having a thin, elongated section which could be frictionally engaged and held by the disclosed holding device. Also, the depicted invention could be constructed of any suitably resilient material other than plastics, such as leather. Many variations thereof will be evident to one skilled in the art and are intended to be encompassed in the present invention as set forth in the following claims.

I claim:

1. A golf club retaining apparatus to be worn on the person, comprising:

a substantially rectangular main body having a unitary construction and fabricated of substantially resilient material;

said main body having a U-shaped slot formed therein so as to define a center flap and a peripheral support;

said peripheral support being adapted to be affixed to a portion of the apparel of the user;

means formed in said flap for holding a golf club, said means including:

a hole formed in said flap with a second slot joining said hole with one side of the outer edge of said flap, giving said flap a hooked appearance and thereby allowing a golf club shaft to pass through said second slot and into said hole of said flap such that when said apparatus is affixed to said apparel portion of the user said golf club depends from said flap.

2. A golf club retaining apparatus according to claim 1, wherein:

said main body is fabricated of a substantially resilient molded plastic material.

3. A golf club retaining apparatus according to claim 1, wherein:

said main body is dimensioned such that said peripheral support may be fitted within a pants pocket of the user.

4. A golf club retaining apparatus according to claim 1, wherein:

said main body is substantially flat when not in use.

5. A golf club retaining apparatus according to claim 1, wherein:

said flap and said peripheral support are adapted to be substantially coplanar when said apparatus is not in use; and said flap is angled outwardly from said peripheral support when said apparatus is in use with said golf club depending from said flap.

6. A golf club retaining apparatus according to claim 1, wherein:

said main body has a thickness of approximately 0.15 inch.

7. A golf club retaining apparatus according to claim 1, wherein:

said main body has a width dimension of approximately 3.5 inches and a length dimension of approximately 5 inches.

8. A golf club retaining apparatus according to claim 1, wherein:

said main body has rounded corner portions; and said hole in said flap is substantially rectangular with rounded corners.

9. A golf club retaining apparatus according to claim 1, wherein:

said hole and said second slot in said flap are formed in a lower portion of said flap.

* * * * *